US007513811B2

(12) United States Patent
Kameoka et al.

(10) Patent No.: US 7,513,811 B2
(45) Date of Patent: Apr. 7, 2009

(54) IDLE EXHAUST STRUCTURE FOR OUTBOARD MOTOR

(75) Inventors: Kentaro Kameoka, Shizuoka-ken (JP); Masanori Takahashi, Shizuoka-ken (JP); Kimitaka Saruwatari, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/617,528

(22) Filed: Dec. 28, 2006

(65) Prior Publication Data

US 2008/0020659 A1 Jan. 24, 2008

(30) Foreign Application Priority Data

Apr. 14, 2006 (JP) ..... 2006-111965

(51) Int. Cl.
*B63H 21/34* (2006.01)

(52) U.S. Cl. ..... 440/89 G; 440/89 J

(58) Field of Classification Search ..... 440/89 G, 440/89 J

See application file for complete search history.

(56) References Cited

U.S. PATENT DOCUMENTS 3,967,446 A * 7/1976 Harralson et al. ..... 60/312
4,034,561 A 7/1977 Sakurai et al.
5,374,209 A 12/1994 Wagner
5,487,688 A * 1/1996 Sumigawa ..... 440/88 L
6,471,559 B2 10/2002 Kashima
2005/0260900 A1 * 11/2005 Nakata et al. ..... 440/89 R
2008/0026654 A1 1/2008 Konakawa et al.

FOREIGN PATENT DOCUMENTS

JP 09-049425 2/1997
JP 2000-303818 10/2000
JP 2007-283894 11/2007

OTHER PUBLICATIONS

Co-Pending U.S. Appl. No. 11/645,983, filed Dec. 27, 2006, Title: Multiple-Cylinder Engine for Outboard Motor. Inventors: Iwata et al.

* cited by examiner

*Primary Examiner*—Ed Swinehart
(74) *Attorney, Agent, or Firm*—Knobbe, Martens, Olson & Bear, LLP

(57) ABSTRACT

An outboard motor can include a case that extends longitudinally and can be supported on a hull of a boat. An engine can be supported on the upper surface side of the case and a cowling can be supported on the upper end portion of the case for covering the engine from the outside. An idle exhaust passage can be formed to discharge exhaust produced during idling of the engine to the atmosphere from the inside of the case. An expansion chamber can be formed at a midway portion of the idle exhaust passage. The downstream end of the idle exhaust passage can serve as an idle exhaust port that is open to the atmosphere. A plurality of such idle exhaust ports can be formed.

10 Claims, 8 Drawing Sheets

IDLE EXHAUST STRUCTURE FOR OUTBOARD MOTOR

This application is based on and claims priority to Japanese Patent Application No. 2006-111965, filed Apr. 14, 2006, the entire contents of which is hereby expressly incorporated by reference.

BACKGROUND OF THE INVENTIONS

1. Field of the Inventions

The present inventions relate to exhaust systems for outboard motors, and more particularly, idle exhaust systems for outboard motors.

2. Description of the Related Art

Examples of conventional outboard motors include one disclosed in Japanese Patent Document JP-A-2000-303818. An outboard motor in this patent document includes a case extending longitudinally that can be supported on the hull of a boat and whose lower part can be immersed in water. A propeller is supported on the lower end portion of the case. Additionally, an engine is supported on the upper surface side of the case and operatively coupled with the propeller.

In this design, inside the case, there are formed a main exhaust passage for introducing exhaust produced during operation of the engine to the inside of the case and discharging the exhaust from the inside of the case into water, and an idle exhaust passage that branches off from the main exhaust passage to discharge a part of the exhaust to the atmosphere above the water line. Further, an expansion chamber is formed at a midway portion of the idle exhaust passage. The downstream end of the idle exhaust passage serves as an idle exhaust port that is open to the atmosphere.

When the propeller is operated in synchronization with this engine during operation of the engine, this allows the boat to be propelled. Most of the exhaust produced during the operation of the engine is discharged into the water by way of the main exhaust passage below the waterline. This discharge of the exhaust into the water prevents generation of exhaust noise.

On the other hand, it is difficult to discharge exhaust produced during idling of the engine into the water by way of the main exhaust passage due to its low exhaust pressure. In other words, the water pressure prevents, even at a position immediately below the surface of the water, can prevent exhaust gas from smoothly being discharged during idle operation. Accordingly, the exhaust produced during idling is discharged to the atmosphere by way of the idle exhaust passage above the waterline. In this case, the noise of this exhaust is muffled as the exhaust passes through the expansion chamber at a midway portion of the idle exhaust passage. The generation of exhaust noise during idling is thus also prevented.

SUMMARY OF THE INVENTION

As noted above, the idle exhaust port can be formed at a longitudinally midway portion of the case. An aspect of at least one of the embodiments disclosed herein include the realization that in cases such as when the waves are high, the idle exhaust port can become blocked as it is covered with water from the waves. Further, it is also possible that foreign material can enter the idle exhaust passage through the idle exhaust port. When this occurs, smooth idling is impaired disadvantageously.

Further, when seawater enters the idle exhaust passage through the idle exhaust port due to exhaust pulsation or the like, the lifespan of the outboard motor can be reduced due to premature corrosion that can occur inside the respective exhaust passages.

Thus, in accordance with an embodiment, an idle exhaust structure for an outboard motor can be provided. The outboard motor can include an engine and a cowling for covering the engine from an outside thereof. The idle exhaust structure can comprise an idle exhaust passage for discharging exhaust produced during idling to an atmosphere and an expansion chamber formed at a midway portion of the idle exhaust passage. The idle exhaust passage can have a plurality of idle exhaust ports formed at a downstream end of the idle exhaust passage and open to the atmosphere.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 2:
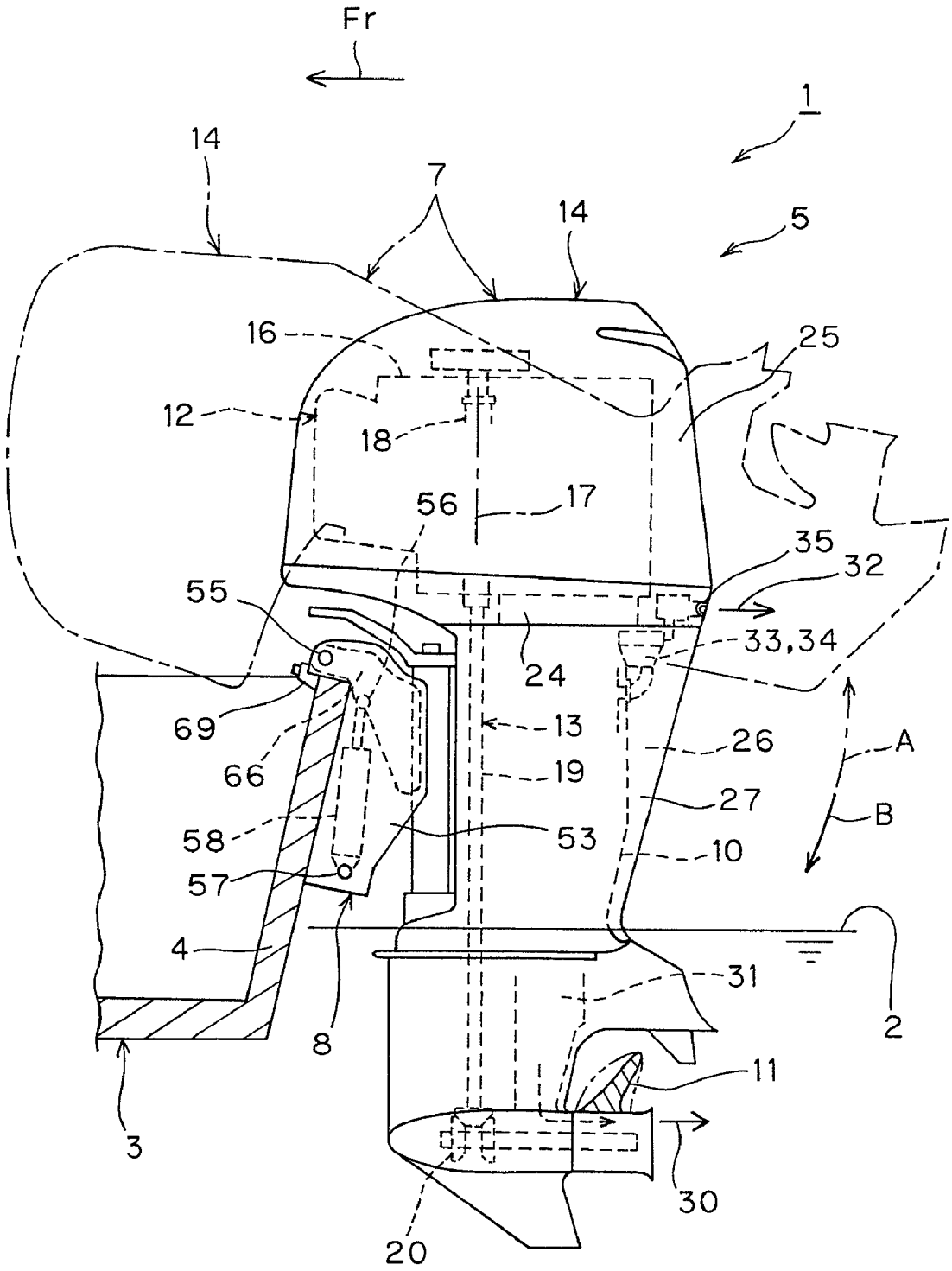
FIG. 2 is a side elevational view of the outboard motor of FIG. 1, showing the rear portion of a boat to which the outboard motor is attached and showing a tilted-up position of the outboard motor in phantom line.

In FIG. 2, reference numeral 1 denotes a boat floating on the surface of water 2, such as seawater. Further, the arrow Fr indicates the forward side in the propulsion direction of the boat 1. Although the present exhaust systems are illustrated and described in the context of an outboard motor, certain aspects of the present inventions can be used with engines of other types of vehicles, as well as with other types of prime movers.

The boat 1 can include a hull 3 and an outboard motor 5 that can be supported on a stem board 4 of the hull 3. The stem board 4 extends upwardly at a rearward end of the bottom of the hull 3.

The outboard motor 5 can include an outboard motor main body 7 and a support device 8. The outboard motor main body 7 can be arranged in rear of the hull 3 and can generate a propulsion force to propel the hull 3. The support device 8 pivotally supports the outboard motor main body 7 so that the lower side of the outboard motor main body 7 can follow a tilt-up motion A (indicated by the one-dot chain line in FIG. 2) upwardly and rearwardly and a tilt-down motion B (indicated by the solid line in FIG. 2).

With continued reference to FIG. 2, the outboard motor main body 7 can include a case 10 that extends in its longitudinal direction (generally vertical). The upper portion of the case 10 can be supported on the stem board 4 by means of the support device 8. The lower portion of the case 10 can be immersed in the water 2. A propeller 11 can be supported on the lower end portion of the case 10.

An engine 12, such as an internal combustion engine, can be supported on the upper surface side of the case 10. A power transmission mechanism 13 can also be accommodated in the case 10 and operatively coupling the propeller 11 to the engine 12. A cowling 14 can be supported on the upper end portion of the case 10 for covering the entire engine 12, an can be configured to be freely opened and closed.

The engine 12 can include a crankcase 16 supported on the upper surface side of the case 10, and a crankshaft 18 supported on the crankcase 16 for rotation bout an axis 17 that extends in the longitudinal direction. The power transmission mechanism 13 can include a power transmission shaft 19 and a gear set 20. The power transmission shaft 19 can be supported on the case 10 or rotation about the axis 17, and its upper end portion can be operatively coupled with the crankshaft 18. The gear set 20 operatively couples the propeller 11 to the lower end portion of the power transmission shaft 19. The axis 17 can be located substantially on a centerline 21 in the width direction of the outboard motor 5.

The cowling 14 can include a bottom cowling 24 and a cowling main body 25. The bottom cowling 24 can be supported on the upper surface side at the upper end portion of the case 10, and can cover the entire lower portion of the engine 12 from the out side. The cowling main body 25 can cover the entire upper portion of the engine 12 and can be configured to be freely opened and closed. The lower edge portion of the cowling main body 25 can be detachably engaged with the upper edge portion of the bottom cowling 24 by means of a locking member (not shown). The cowling main body 25 can be supported on the bottom cowling 24 due to this locking engagement.

Figure 1:
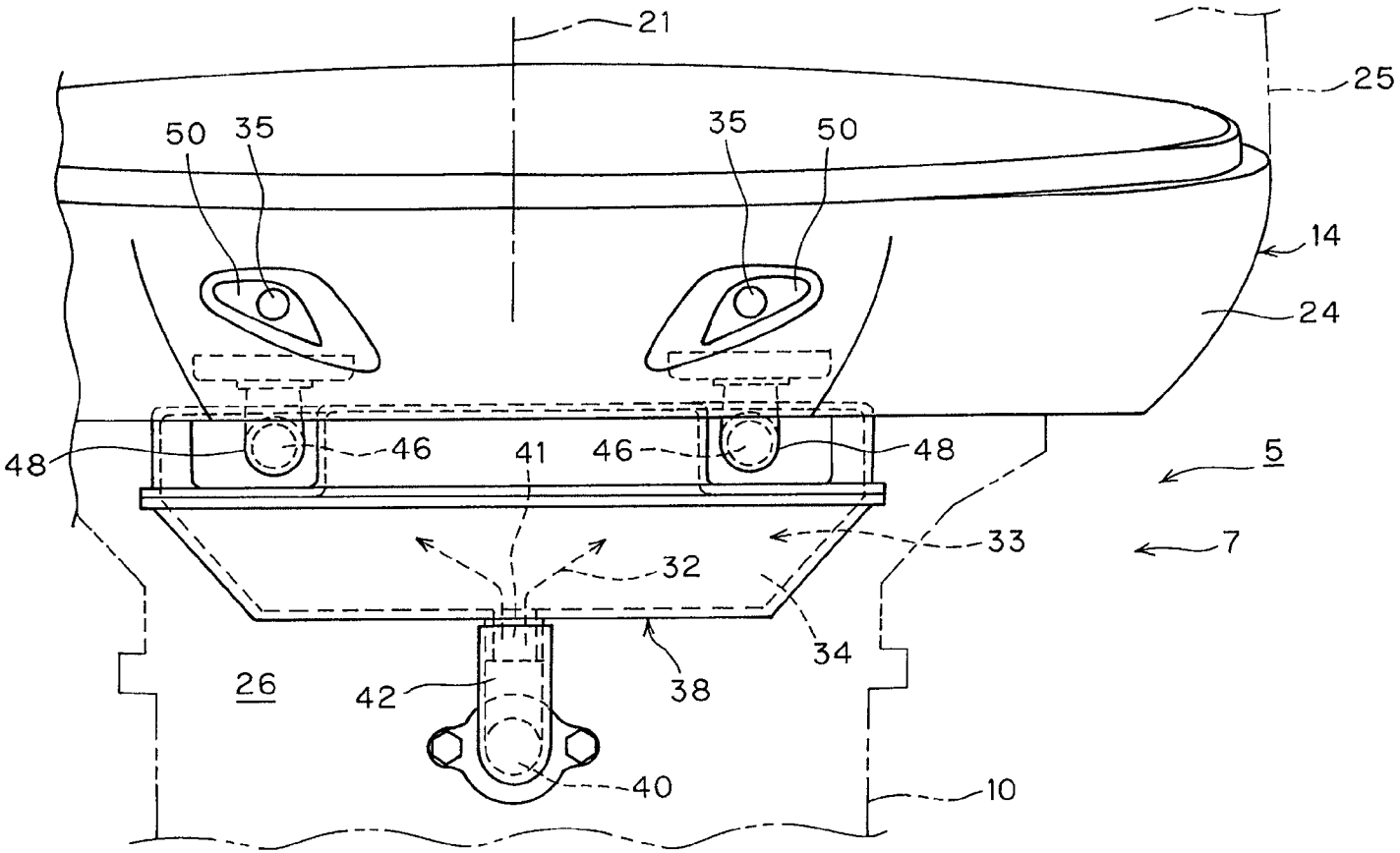
FIG. 1 is a partial rear elevational view of a portion of an outboard motor in accordance with an embodiment.

As seen in plan view (FIG. 3), the outer edge portion of the cowling 14 corresponds to the joining portion between the bottom cowling 24 and the cowling body 25, and can be located higher than the upper end portion of the case 10, as shown in FIG. 1. The outer edge portion of the cowling 14 projects outward in the horizontal direction with respect to the upper end portion of the case 10.

As shown in FIG. 2, the portion of the crankcase 16 located in the area outside of the case 10 and below the outer edge portion of the cowling 14 can be a dead space. More specifically, the rear portion of the bottom cowling 24 which forms the above-mentioned outer edge portion projects outwardly (rearwardly) in the horizontal direction with respect to the rear surface of the upper portion of the case 10. Also, a space 26, which can be located in the area in rear of the upper portion of the case 10 and below the rear portion of the bottom cowling 24, can also be a dead space. An apron 27 detachably secured onto the case 10 can be provided so as to cover the space 26 from the rear.

In FIGS. 1 to 5, a main exhaust passage 31 can be formed inside the case 10. The main exhaust passage 31 can serve to introduce or guide an exhaust gas 30 produced during operation of the engine 12 into the case 10 and to discharge the exhaust 30 from the case 10 into the water 2. Further, an idle exhaust passage 33 can be formed so as to discharge an exhaust 32, which can be produced during idling of the engine 12, to the atmosphere side from a midway portion of the main exhaust passage 31 inside the case 10. An expansion chamber 34 can be formed at a midway portion of the idle exhaust passage 33. A plurality of (two) idle exhaust ports 35 open to the atmosphere side can be formed at the downstream end of the idle exhaust passage 33.

Figure 3:
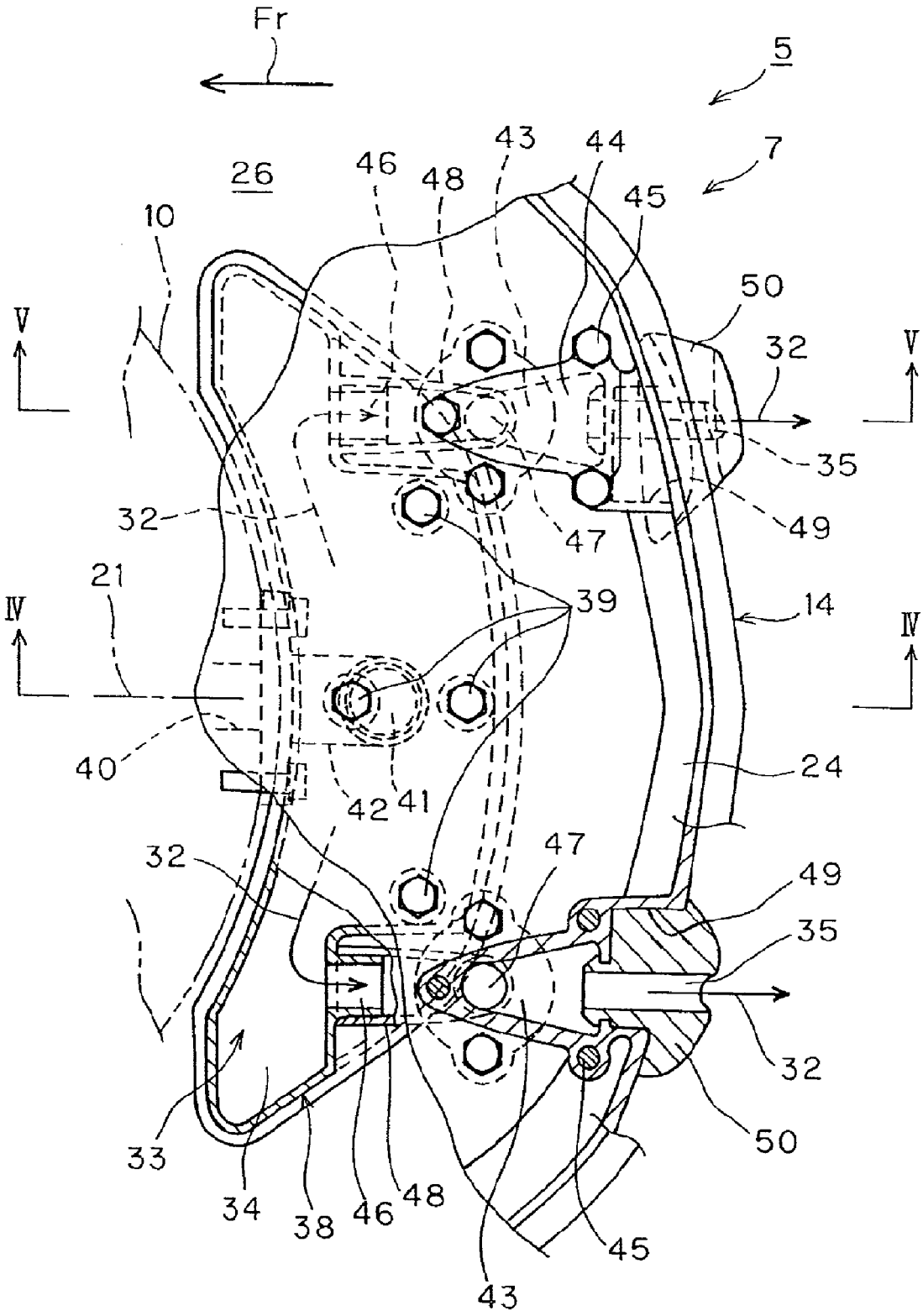
FIG. 3 is a partially sectional plan view of portion of the outboard motor of FIG. 1.
Figure 4:
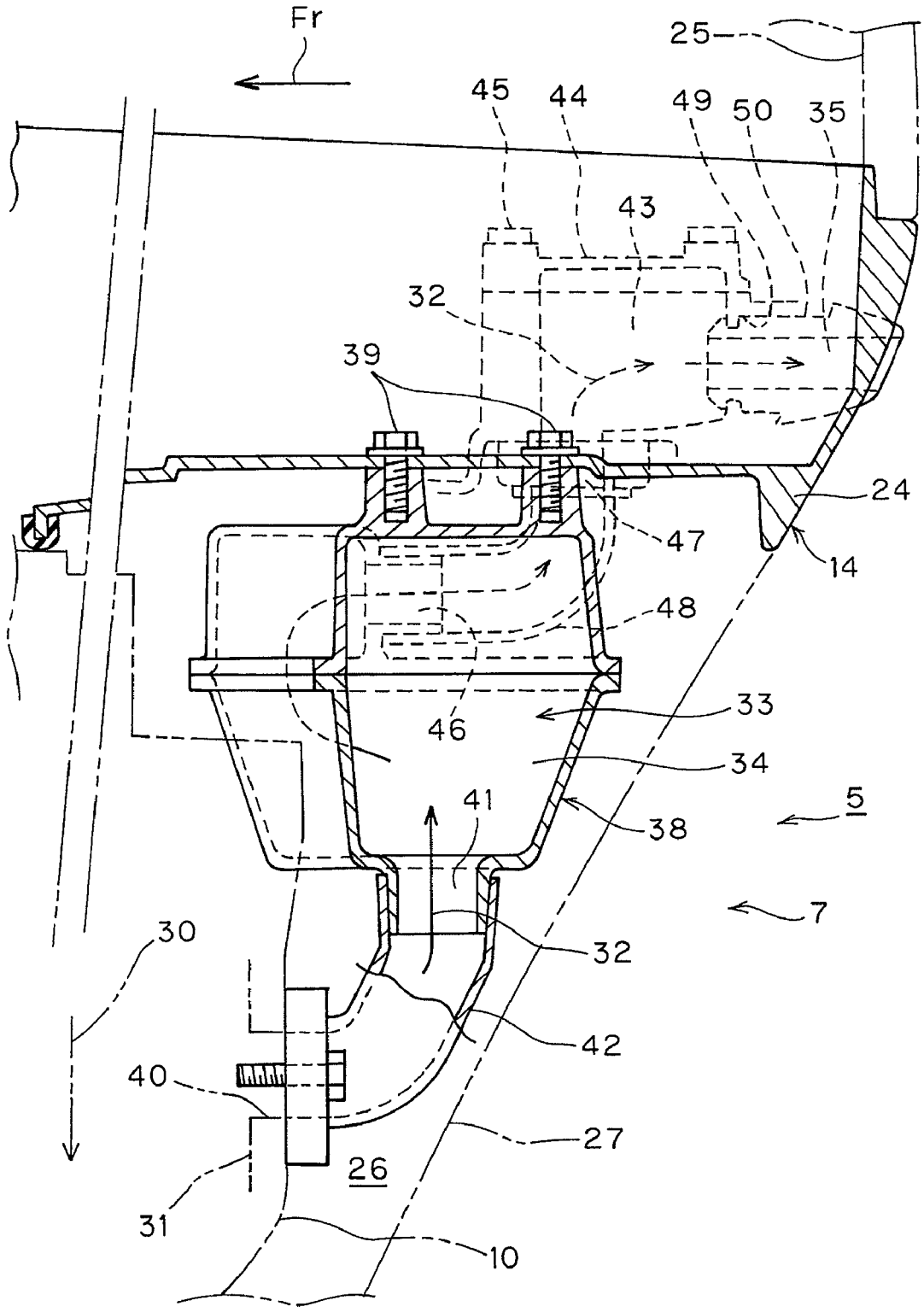
FIG. 4 is a sectional view, taken along the arrow line IV-IV of FIG. 3.
Figure 5:
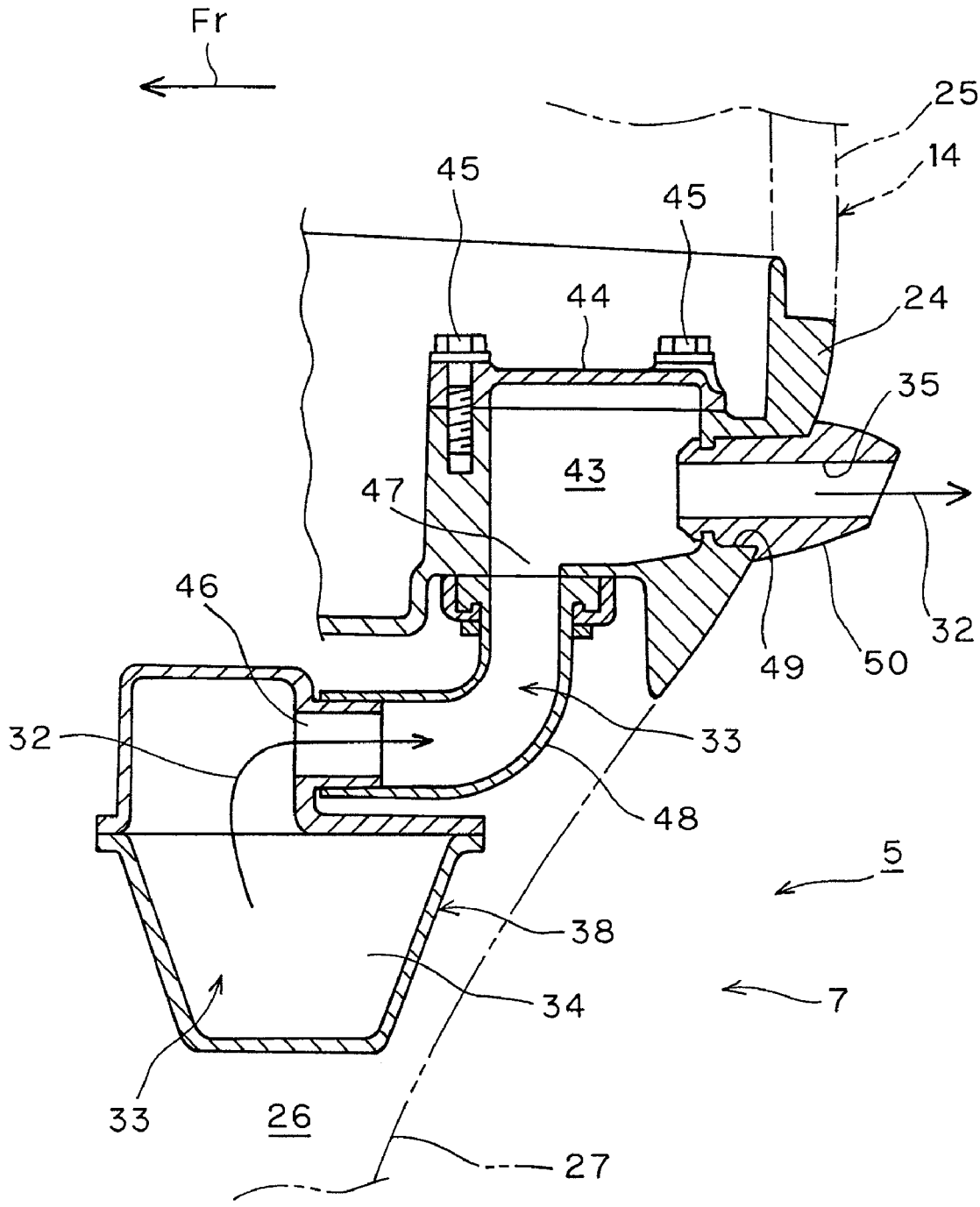
FIG. 5 is a sectional view, taken along the arrow line V-V of FIG. 3.

With reference to FIGS. 3-5, an expansion chamber case 38, which can form the expansion chamber 34, can be arranged in an upper portion of the space 26. The expansion chamber case 38 can be directly attached onto the lower surface of the rear portion of the bottom cowling 24 by means of fasteners 39.

A branching opening 40, which serves to branch off the main exhaust passage 31 at its midway portion so as to be open toward the space 26, can be formed in the rear surface of the case 10 located below and near the expansion chamber case 38. A communication tube 42 can be provided to communicate the branching opening 40 with an inlet portion 41 at the bottom of the expansion chamber case 38.

An additional expansion chamber 43 can be formed in the portion of the idle exhaust passage 33 between the expansion chamber 34 and the idle exhaust port 35. More specifically, a plurality of (a pair of left and right) upwardly open recesses can be formed in the rear portion of the bottom cowling 24 located in rear of the case 10. Covers 44 can be provided to close these respective recesses from above. The covers 44 can be detachably secured to the opening edge portions of the recesses by means of fasteners 45.

Further, the interior portion of each of the recesses closed by the covers 44 can define the additional expansion chamber 43. A plurality of (a pair of left and right) other communication tubes 48 can also be provided to communicate a plurality of (a pair of left and right) outlet portions 46 formed in an upper portion of the expansion chamber case 38, and respective inlet portions 47 formed at the bottom of the respective additional expansion chambers 43.

A plurality of (a pair of left and right) communication holes 49 for communicating each of the additional expansion chambers 43 with the atmosphere side in rear of the bottom cowling 24 can be formed in the rear portion of the bottom cowling 24. Exhaust port members 50 having the idle exhaust ports 35 formed therein can be fitted in the respective communication holes 49 and can be detachably locked onto the rear portion of the bottom cowling 24. The respective idle exhaust ports 35 can also be arranged to be spaced apart from each other with respect to the width direction of the outboard motor 5 (e.g., laterally spaced).

The additional expansion chamber 43 can be formed independently for each of the idle exhaust ports 35. Further, the additional expansion chamber 43 can be arranged higher than and near the expansion chamber 34. As shown in the plan view of the outboard motor 5 (FIG. 3), the expansion chambers 34 and the additional expansion chambers 43 are arranged close to each other. Further, at least a part of (in the illustrated example, substantially the entirety of) the additional expansion chambers 43 can be formed in the rear portion of the bottom cowling 24 of the cowling 14.

As also seen in the plan view of the outboard motor 5 (FIG. 3), the upper rear surface of the case 10 can have an arcuate configuration that can be convex on its rearward side. The expansion chamber case 38 can also extend in an elongated fashion in the width direction of the outboard motor 5 so as to form an arcuate configuration in conformity with the upper rear surface of the case 10 and be laterally symmetrical about the centerline 21.

The idle exhaust ports 35, the communication tubes 42, the additional expansion chambers 43, the other communication tubes 48, and the exhaust port members 50, which can be arranged on the left and right sides, can be arranged at laterally symmetrical positions about the centerline 21 and symmetrical in configuration. The respective interior portions of the idle exhaust ports 35, expansion chamber case 38, branching opening 40, communication tubes 42, additional expansion chambers 43, and communication tubes 48 are communicated with each other to define the idle exhaust passage 33.

During the operation of the engine 12, the propeller 11 can be operated in synchronization with the engine 12 via the power transmission mechanism 13 which can thus propel the boat 1. Most of the exhaust 30 produced during the operation of the engine 12 is discharged into the water 2 through the main exhaust passage 31. This discharge of the exhaust 30 into the water 2 reduces the exhaust noise.

On the other hand, since the exhaust pressure of the exhaust 32 produced during idling of the engine 12 can be low, it can be difficult to discharge the exhaust 32 into the water 2 through the main exhaust passage 31. Thus, the exhaust 32 during idling can be discharged through the idle exhaust passage 33 to the atmosphere. In this case, the noise of the exhaust 32 can be muffled as it passes through the expansion chamber 34 provided at a midway portion of the idle exhaust passage 33. This reduces the exhaust noise during idling.

As noted above, a plurality of idle exhaust ports 35 are formed. Thus, even when the respective idle exhaust ports 35 are be covered with water 2 (e.g., by large waves) and become blocked, the likelihood of all of the plurality of idle exhaust ports 35 formed as described above being simultaneously blocked is lower. That is, the exhaust 32 during idling can be discharged through either one of the idle exhaust ports 35.

Further, while the total opening area of the idle exhaust ports 35 can be of a predetermined size, the opening area of each of the individual idle exhaust ports 35 can be made smaller. Accordingly, the intrusion of large-sized foreign matter into the idle exhaust passage 33 via the idle exhaust ports 35 can be reduced. That is, the exhaust 32 during idling can be discharged through the respective idle exhaust ports 35 without being obstructed by such foreign matters. Thus, the first and second features described above ensure smoother idling of the engine 12 of the outboard motor 3.

Additionally, reducing the opening area of each of the individual idle exhaust ports 35, can further enhance the noise reduction effect to further reduce exhaust noise.

Further, as described above, the respective idle exhaust ports 35 can be arranged in a spaced apart manner with respect to the width direction of the outboard motor 5. Accordingly, in cases such as when the waves are high, the likelihood of the respective idle exhaust ports 35 spaced apart from each other as described above being covered with water 2 and simultaneously blocked is further suppressed. This ensures smoother idling of the engine 12 of the outboard motor 5.

As described above, the idle exhaust ports 35 can be formed in the bottom cowling 24 of the cowling 14. Accordingly, as compared with the related art in which the idle exhaust ports are formed in the case, the idle exhaust ports 35 can be arranged at a higher position. Thus, firstly, the likelihood of the idle exhaust ports 35 being blocked with the water 2 can be more reliably suppressed. As a result, smoother idling of the engine 12 of the outboard motor 5 can be ensured.

Second, the likelihood of the water 2 entering the idle exhaust passage 33 through the idle exhaust ports 35 due to exhaust pulsation or the like can be more reliably suppressed, thereby preventing premature corrosion of the interior of each of the exhaust passages 31, 33 by the water 2. As a result, the outboard motor 5 can be given a longer duration of life securely.

Further, as described above, the case 10 can be supported on the hull 3 while extending longitudinally and supports the engine 12 on its upper surface side can be provided. The expansion chamber 34 can be formed by the expansion chamber case 38, and the expansion chamber case 38 can be disposed within the space in the area outside the case 10 in the horizontal direction and below the portion of the cowling 14 located above the case 10 (the outer edge portion of the cowling 14).

In this regard, when the above-mentioned space is present, this space tends to become a dead space. Accordingly, as described above, the expansion chamber case 38 can be disposed in this space. Since the above-mentioned space is thus effectively used for the disposition of the expansion chamber case 38, the outboard motor 5 can be made correspondingly compact.

Further, as described above, the cowling 14 can include the bottom cowling 24 that can be supported on the upper end portion of the case 10, and the cowling main body 25 that can be supported on the bottom cowling 24, with the expansion chamber case 38 being disposed within the space in the area in rear of the upper portion of the case 10 and below the rear portion of the bottom cowling 24.

Since the expansion chamber case 38 can be thus disposed outside of each of the case 10 and the bottom cowling 24, maintenance and inspection work such as cleaning of the expansion chamber case 38 can be further facilitated.

In this regard, as described above, the rear portion of the bottom cowling 24 can project rearwardly with respect to the upper portion of the case 10, and the space 26 tends to become a dead space. Accordingly, the expansion chamber case 38 can be disposed in this space as described above. Since the above-mentioned space 26 can be thus effectively used for the disposition of the expansion chamber case 38, the outboard motor 5 can be made correspondingly compact.

Ss described above, the expansion chamber case 38 can be directly attached to the bottom cowling 24 of the cowling 14. Thus, the bottom cowling 24 of the cowling 14 and the expansion chamber case 38 can be positioned closer to each other. Thus, firstly, an unnecessary space is prevented from being formed between the cowling 14 and the expansion chamber case 38. The volume of the expansion chamber 34 of the expansion chamber case 38 can be thus increased through the use of the above-mentioned space, thereby achieving a further improvement in the noise reduction effect of the expansion chamber 34.

Secondly, when the idle exhaust ports 35 are formed in the bottom cowling 24 of the cowling 14, in particular, the communication tube 48 for communicating each of the idle exhaust ports 35 of the bottom cowling 24 of the cowling 14 with the expansion chamber 34 of the expansion chamber case 38 can be made short, or the communication tube 48 can be eliminated together, thereby making it possible to further simplify the construction of the outboard motor 5.

Additionally, as noted above, the additional expansion chamber 43 can be formed in the portion of the idle exhaust passage 33 between the expansion chamber 34 and the idle exhaust port 35. Accordingly, the sum total volume of the respective expansion chambers 34 and the additional expansion chamber can be increased, thereby achieving a further improvement in their noise reduction effect.

Since it is desirable to make outboard motors as small as possible, it is desirable to eliminate or reduce excess spaces. Accordingly, as described above, the additional expansion chamber 43 can be formed separately from the expansion chamber 34, thereby facilitating the use of the respective portions of any excess space.

As described above, the additional expansion chamber 43 can also be formed independently for each of the idle exhaust ports 35. Accordingly, when the idle exhaust ports 35 are largely spaced apart from each other, in particular, the formation of the respective additional expansion chambers 43 can be facilitated as compared with the case where the additional expansion chambers 43 are formed integrally with each other.

The additional expansion chamber 43 can also be arranged above the expansion chamber 34. In this regard, there are cases when two outboard motors 5 are provided in parallel in the width direction of the hull 3 and supported on the stem board 4 of the hull 3. Hence, in order to avoid interference between the two outboard motors 5, it can be preferable that the outboard motors 5 be made more compact as seen in plan view.

Accordingly, the additional expansion chamber 43 can be located higher than the expansion chamber 34 as described above. Therefore, the outboard motor 5 can be made more compact as compared with the case where the expansion chamber 34 and the additional expansion chamber 43 are provided in parallel in the horizontal direction.

As described above, at least a part of the additional expansion chamber 43 can be formed in the cowling 14. Accordingly, the cowling 14 can be used for forming the additional expansion chamber 43, so the construction of the engine 12 can be correspondingly simplified.

Further, as seen in the plan view (FIG. 3) of the outboard motor 5, the expansion chamber case 38 can be formed so as to have an arcuate configuration in conformity with the upper rear surface of the case 10. Accordingly, the above-mentioned space 26 can be effectively used, whereby the volume of the expansion chamber 34 of the expansion chamber case 38 can be made larger. A further improvement can be thus achieved in terms of the noise reduction effect of the expansion chamber 34.

In FIGS. 2 and 6 to 8, the support device 8 includes a bracket 53 detachably supported on the stem board 4, a pivot shaft 55 whose axis 54 extends in the width direction of the outboard motor 5 and which pivotally supports the outboard motor main body 7 on the bracket 53 so as to allow the tilt-up A (indicated by the one-dot chain line in FIG. 2 and FIG. 8) or tilt-down B (indicated by the solid line in FIG. 2, FIGS. 6 and 7) of the outboard motor main body 7 about the axis 54. A hydraulic cylinder 58 whose ends are pivotally supported on the outboard motor main body 7 and the bracket 53 by means of upper and lower pivot pins 56, 57 straddle the outboard motor main body 7 and the bracket 53. The elongation or contraction of the hydraulic cylinder 58 allows the outboard motor main body 7 to make a tilt-up A or tilt-up B motion about the axis 54.

The bracket 53 can include a base plate 61, left and right side plates 62, 63, and left and right projections 64. The base plate 61 can be surface joined with the rear surface of the stem board 4 and detachably secured to the stem board 4 by means of fasteners (not shown). The left and right side plates 62, 63 integrally extend rearwardly from respective outer edge portions of the base plate 61. The left and right projections 64 integrally project forwardly from the upper end portions of the side plates 62, 63 and can be placed on the upper surface of the upper edge portion of the stem board 4. Respective axes 59 of the pivot pins 56, 57 are parallel to the axis 54 of the pivot shaft 55.

A pivot arm 66 constituting the outboard motor main body 7 and projecting forwardly from the case 10 side can be pivotally supported by means of the pivot shaft 55 with respect to the left and right projections 64. Further, the hydraulic cylinder 58 can be suspended between the pivot arm 66 of the outboard motor main body 7 and the left and right side plates 62, 63 by means of the pivot pins 56, 57.

Stoppers 69 can be detachably secured to the lower front end portions of the respective projections 64 of the bracket 53 respectively by means of fasteners 68. The stoppers 69 abut the front surface of the upper edge portion of the stem board 4.

In this regard, at the manufacturing site of the outboard motor 5, the bracket 53 constituting part of the outboard motor 5 or the bracket 53 alone can be temporarily hanged with respect to a hanging stand that is the same in shape and size as the upper edge portion of the stem board 4. When performing this temporary hanging, the stopper 69 abuts the front surface of the hanging stand and stable temporary hanging can be therefore reliably performed. Further, an improvement is thus achieved in terms of workability at the manufacturing site of the outboard motor 5.

On the other hand, when the bracket 53 is first temporarily hanged to the stem board 4 in order to support the outboard motor 5 thereon, if the thickness of the stem board 4 is not larger than that of the hanging stand, the temporary hanging to the stem board 4 can be facilitated, that is, the outboard motor 5 can be easily supported onto the stem board 4.

However, there are some stem boards 4 having a thickness larger than that to be expected, for reasons such as enhancing the strength of the stem board 4. In this case, the stopper 69 interferes with the above-mentioned temporary hanging, thus making it difficult to support the bracket 53 onto the stem board 4. Accordingly, in such cases, the above fastener 68 is loosened, to thereby remove each of the stoppers 69 from each of the projections 64 of the bracket 53. This makes it possible to support the bracket 53 onto the stem board 4. That is, as described above, the stopper 69 can be detachably secured with respect to each of the projections 64 of the bracket 53.

Accordingly, as compared with the related art in which the stopper 69 is formed integrally with the projection 64, the attachment/detachment of the stopper 69 allows the bracket 53 to be applied to both the manufacturing site of the outboard motor 5 and to the actual hull 3.

Figure 6:
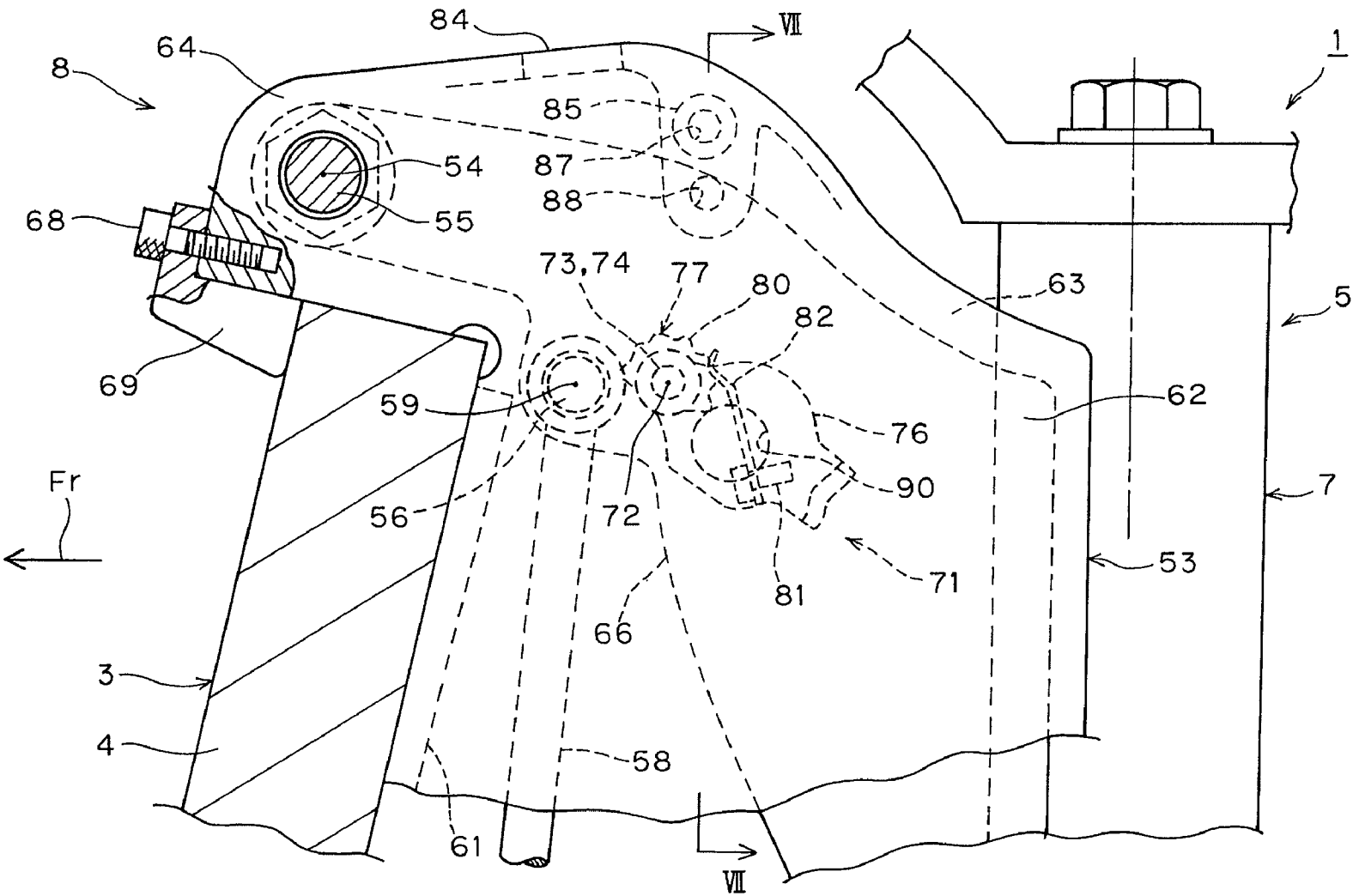
FIG. 6 is an enlarged side elevational view of the clamping bracket and the rear portion of the boat of FIG. 2.
Figure 7:
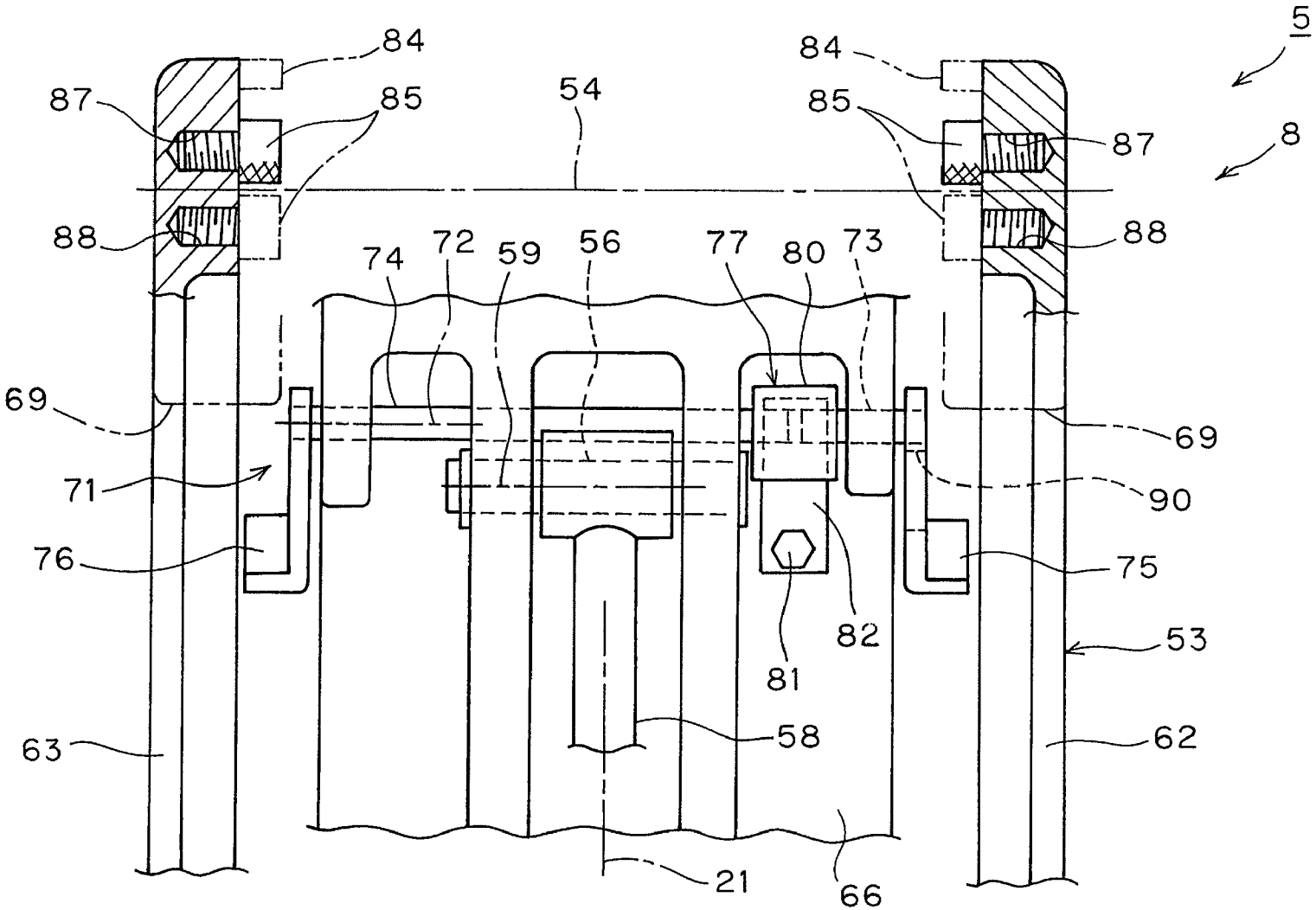
FIG. 7 is a sectional view, taken along the arrow line VII-VII of FIG. 6.
Figure 8:
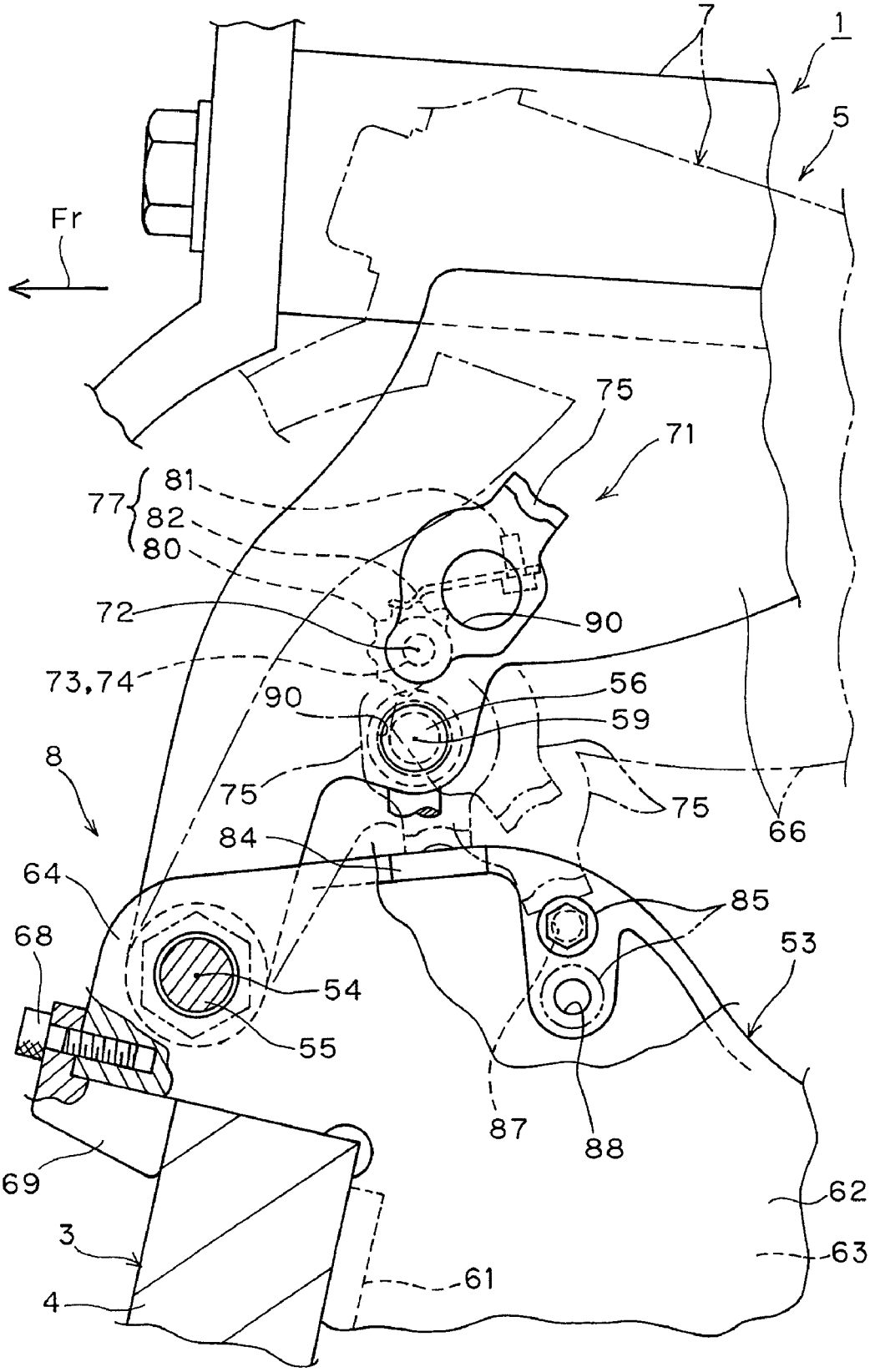
FIG. 8 is an enlarged side elevational view of the clamping bracket and the rear portion of the boat of FIG. 2, with the outboard motor tilted-up relative to the position shown in FIG. 6.

In FIGS. 6 to 8, a tilt-up position retainer 71 can be provided. With the outboard motor main body 7 being in the tilt-up A state due to the extension of the hydraulic cylinder 58, the tilt-up position retainer 71 can retain the outboard motor main body 7 in either one of a high position (indicated by the solid line in FIG. 8) and a lower position (indicated by the two-dot chain line in FIG. 8). That is, with the tilt-up position retainer 71, during the tilt-up A of the outboard motor main body 7, spontaneous falling of the outboard motor main body 7 due to spontaneous retraction of the hydraulic cylinder 58 can be prevented by retaining the outboard motor main body 7 in a desired position as described above.

The tilt-up position retainer 71 can include left and right rotary shafts 73, 74, left and right locking arms 75, 76, and a detent device 77. The left and right rotary shafts 73, 74 can be supported on the pivot arm 66 of the outboard motor main body 7 near the pivot pin 56 on the upper side for rotation about an axis 74 that can be parallel to the axis 59 of the pivot pin 56. The left and right locking arms 75, 76 can be provided so as to project from the respective ends of the left and right rotary shafts 73, 74 projecting toward the outside of the pivot arm 66.

The detent device 77 can be configured to elastically position the locking arms 75, 76 between a plurality of rotational positions including a first rotational position (indicated by the solid line in FIGS. 6 to 8), a second rotational position (indicated by the one-dot chain line in FIG. 8), and a third rotational position (indicated by the two-dot chain line in FIG. 8).

The detent device 77 can include a gear 80 and a plate spring 82. The gear 80 can be located on the axis 72, and can rotate together with the left and right rotary shafts 73, 74 while connecting the opposing ends of the left and right rotary shafts 73, 74 to each other by means of a snap ring. The spring 82 can be attached to the pivot arm 66 by means of a fastener 81, and can come into press contact with the outer peripheral surface of the gear 80 to be elastically fitted in the respective tooth spaces of the gear 80, thereby making it possible to position each of the locking arms 75, 76 in the plurality of, that is, the first to third rotational positions mentioned above.

The tilt-up position retainer 71 can include left and right high-position retaining portions 84 with which the locking arms 75, 76 in the second rotational position (indicated by the one-dot chain line in FIG. 8) are brought into locking engagement, to thereby retain the outboard motor main body 7 in the high position (indicated by the solid line in FIG. 8), and left and right low-position retaining portions 85 with which the locking arms 75, 76 in the third rotational position (indicated by the two-dot chain line in FIG. 8) are brought into locking engagement, to thereby retain the outboard motor main body 7 in the low position (indicated by the two-dot chain line in FIG. 8).

More specifically, during the tilt-up A or tilt-down B of the outboard motor main body 7, the locking arms 75, 76 in the first rotational position do not engage at all with the high-position retaining portions 84 and the low-position retaining portions 85. The high-position retaining portions 84 can be protrusions formed integrally with the upper end portions of the side plates 62, 63 of the bracket 53, respectively. When, after the tilt-up A of the outboard motor main body 7, the respective locking arms 75, 76 are brought into the second rotational position, and the tilt-down B can be started, the respective locking arms 75, 76 are brought into locking engagement with the respective high-position retaining portions 84. The outboard motor main body 7 can be thus retained in the high position (indicated by the solid line and the one-dot chain line in FIG. 8).

Each of the low-position retaining portions 85 can be formed as a bolt. Of a plurality of (two) upper and lower screw holes 87, 88 formed on the inner surface side of the respective side plates 62, 63 of the bracket 53, the respective low-position retaining portions 85 can be screwed into the upper screw holes 87 and supported on the side plates 62, 63. When, after the tilt-up A of the outboard motor main body 7, the respective locking arms 75, 76 are brought into the third rotational position (indicated by the two-dot chain line in FIG. 8), and the tilt-down B can be started, the respective locking arms 75, 76 are brought into locking engagement with the respective low-position retaining portions 85 without coming into locking engagement with the respective high-position retaining portions 84. The outboard motor main body 7 can be thus retained in a low position located lower than the above-mentioned high position (indicated by the two-dot chain line in FIG. 8).

The low-position retaining portions 85 can be selectively screwed into either of the upper end lower screw holes 87, 88. The low-position retaining portions 85 can be supported onto the side plates 62, 63 also by being screwed into the lower screw holes 88 (indicated by the two-dot chain line in FIG. 8). Although not shown, when the respective locking arms 75, 76 in the third rotational position are brought into locking engagement with the low-position retaining portions 85, the outboard motor main body 7 can be retained in a position further lower than the above-mentioned low position.

Recently, commercially available outboard motors have become available with larger, more powerful engines, and thus, the overall size of the outboard motors has become larger. When the main body of a larger outboard motor is tilted-up, there is a possibility that the cowling may touch the hull of the associated boat, making it impossible to tilt the outboard motor to its highest position.

As such, the tilt-up position retainer 71 of the above-described construction can be applied to the outboard motor 5 to avoid such a problem. With the tilt-up position retainer 71, during the tilt-up A of the outboard motor main body 7, the outboard motor main body 7 can be retained in a desired position within the range not causing interference with the hull 3 side.

A through-hole 90 can be formed in one (the locking arm 75) of the left and right locking arms 75, 76. The through-hole 90 can be coaxial with the axis 59 of the upper-side pivot pin 56 when the locking arms 75, 76 are brought into the second rotational position (indicated by the one-dot chain line in FIG. 8). The pivot pin 56 can be attached to and detached from the pivot arm 66 of the outboard motor main body 7 through the through-hole 90.

It should be noted that while the foregoing is directed to the example illustrated in the drawings, the respective expansion chambers 34, 43 can be formed within the case 10. Further, the idle exhaust port 35 can be formed in the case 10, and three or more idle exhaust ports 35 can be formed. Further, the exhaust port member 50 can be formed integrally with the bottom cowling 24. Further, in the case where the cowling 14 has a portion that is located lower than the upper end portion of the case 10, the expansion chamber case 38 can be disposed within this portion.

Further, the other communication tube 48 might not be provided. In some embodiments, the expansion chamber 34 in the expansion chamber case 38 can be directly communicated with the interior of the additional expansion chamber 43.

Further, the high-position retaining portion 84 of the tilt-up position retainer 71 can be a bolt of the same shape and size as the low-position retaining portion 85, and three or more high-position retaining portions 84 can be provided. Further, the low-position retaining portion 85 can be a protrusion that can be formed integrally with each of the side plates 62, 63.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An idle exhaust structure for an outboard motor including an engine and a cowling for covering the engine from an outside thereof, the idle exhaust structure comprising an idle exhaust passage for discharging exhaust produced during idling to an atmosphere, an expansion chamber formed at a midway portion of the idle exhaust passage, the idle exhaust passage having a plurality of idle exhaust ports formed at a downstream end of the idle exhaust passage and open to the atmosphere, a case that extends longitudinally and is configured to be supported on a hull so as to support the engine on an upper surface side of the case, wherein an expansion chamber case defines the expansion chamber, the expansion chamber case being disposed within a space in an area outside of the case in a horizontal direction and below a portion of the cowling located above the case, wherein the idle exhaust ports are arranged spaced apart from each other in a width direction of the outboard motor.

2. The idle exhaust structure for an outboard motor according to claim 1, wherein the cowling includes a bottom cowling supported on an upper end portion of the case, and a cowling main body supported on the bottom cowling, wherein the expansion chamber case is disposed within an space in an area in rear of an upper portion of the case and below a rear portion of the bottom cowling.

3. The idle exhaust structure for an outboard motor according to claim 1, wherein the expansion chamber case is directly attached to the cowling.

4. The idle exhaust structure for an outboard motor according to claim 2, wherein the expansion chamber case is directly attached to the cowling.

5. The idle exhaust structure for an outboard motor according to claim 1, wherein at least one additional expansion chamber is formed in a portion of the idle exhaust passage between the expansion chamber and the idle exhaust ports.

6. An idle exhaust structure for an outboard motor including an engine and a cowling for covering the engine from an outside thereof, the idle exhaust structure comprising an idle exhaust passage for discharging exhaust produced during idling to an atmosphere, an expansion chamber formed at a midway portion of the idle exhaust passage, the idle exhaust passage having a plurality of idle exhaust ports formed at a downstream end of the idle exhaust passage and open to the atmosphere, a case that extends longitudinally and is configured to be supported on a hull so as to support the engine on an upper surface side of the case, wherein an expansion chamber case defines the expansion chamber, the expansion chamber case being disposed within a space in an area outside of the case in a horizontal direction and below a portion of the cowling located above the case, wherein the idle exhaust ports are formed in the cowling.

7. The idle exhaust structure for an outboard motor according to claim 5, wherein the at least one additional expansion chamber is arranged higher than the expansion chamber.

8. The idle exhaust structure for an outboard motor according to claim 6, wherein at least one additional expansion chamber is formed in a portion of the idle exhaust passage between the expansion chamber and the idle exhaust ports.

9. An idle exhaust structure for an outboard motor including an engine and a cowling for covering the engine from an outside thereof, the idle exhaust structure comprising an idle exhaust passage for discharging exhaust produced during idling to an atmosphere, an expansion chamber formed at a midway portion of the idle exhaust passage, the idle exhaust passage having a plurality of idle exhaust ports formed at a downstream end of the idle exhaust passage and open to the atmosphere, a case that extends longitudinally and is configured to be supported on a hull so as to support the engine on an upper surface side of the case, wherein an expansion chamber case defines the expansion chamber, the expansion chamber case being disposed within a space in an area outside of the case in a horizontal direction and below a portion of the cowling located above the case, and a plurality of additional expansion chambers, wherein at least one of the additional expansion chambers is formed independently for each of the idle exhaust ports.

10. An idle exhaust structure for an outboard motor including an engine and a cowling for covering the engine from an outside thereof, the idle exhaust structure comprising an idle exhaust passage for discharging exhaust produced during idling to an atmosphere, an expansion chamber formed at a midway portion of the idle exhaust passage, the idle exhaust passage having a plurality of idle exhaust ports formed at a downstream end of the idle exhaust passage and open to the atmosphere, a case that extends longitudinally and is configured to be supported on a hull so as to support the engine on an upper surface side of the case, wherein an expansion chamber case defines the expansion chamber, the expansion chamber case being disposed within a space in an area outside of the case in a horizontal direction and below a portion of the cowling located above the case, wherein at least one additional expansion chamber is formed in a portion of the idle exhaust passage between the expansion chamber and the idle exhaust ports, and wherein at least a part of the at least one additional expansion chamber is formed in the cowling.

* * * * *

UNITED STATES PATENT AND TRADEMARK OFFICE

CERTIFICATE OF CORRECTION

PATENT NO. : 7,513,811 B2
APPLICATION NO. : 11/617528
DATED : April 7, 2009
INVENTOR(S) : Kentaro Kameoka et al.

It is certified that error appears in the above-identified patent and that said Letters Patent is hereby corrected as shown below:

In Column 2, Line 56, after “a”, please change “stem” to --stern--

In Column 2, Line 56, after “The”, please change “stem” to --stern--

In Column 3, Line 4, please change “stem” to --stern--

In Column 7, Line 11, please change “stem” to --stern--

In Column 7, Line 37, please change “stem” to --stern--

In Column 7, Line 53, after “of the”, please change “stem” to --stern--

In Column 7, Line 54, after “to the”, please change “stem” to --stern--

In Column 7, Line 60, please change “stem” to --stern--

In Column 8, Line 6, please change “stem” to --stern--

In Column 8, Approx. Line 12, please change “stem” to --stern--

In Column 8, Approx. Line 19, before “board”, please change “stem” to --stern--

In Column 8, Approx. Line 20, after “of the”, please change “stem” to --stern--

In Column 8, Approx. Line 22, please change “stem” to --stern--

In Column 8, Approx. Line 23, please change “stem” to --stern--

In Column 8, Approx. Line 24, please change “stem” to --stern--

In Column 8, Approx. Line 26, please change “stem” to --stern--

In Column 8, Approx. Line 28, please change “stem” to --stern--

In Column 8, Approx. Line 32, please change "stem" to --stern--

Signed and Sealed this

Sixth Day of April, 2010

David J. Kappos

David J. Kappos
*Director of the United States Patent and Trademark Office*